US006416014B2

(12) United States Patent
Van Deurse

(10) Patent No.: US 6,416,014 B2
(45) Date of Patent: Jul. 9, 2002

(54) EXPANDABLE CORE PLUG

(75) Inventor: Michael Van Deurse, Norton, MA (US)

(73) Assignee: Double E Company, Inc., W. Bridgewater, MA (US)

( * ) Notice: Subject to any disclaimer, the term of this patent is extended or adjusted under 35 U.S.C. 154(b) by 0 days.

(21) Appl. No.: 09/770,365

(22) Filed: Jan. 25, 2001

Related U.S. Application Data

(60) Provisional application No. 60/178,873, filed on Jan. 29, 2000.

(51) Int. Cl.[7] ..... B65H 75/24

(52) U.S. Cl. ..... 242/571.5; 242/577.1

(58) Field of Search ..... 242/571, 571.3, 242/571.4, 571.5, 577, 577.1, 577.2, 577.3, 596.7, 597.5, 598.4, 599.4, 612; 279/2.19

(56) References Cited

U.S. PATENT DOCUMENTS

| | | | | | |
|---|---|---|---|---|---|
| 805,011 | A | * | 11/1905 | Gomber | 242/571.5 |
| 1,455,195 | A | * | 5/1923 | Foothorap | 242/571.5 |
| 2,891,739 | A | * | 6/1959 | Wolfe | 242/571.5 |
| 4,168,809 | A | * | 9/1979 | Fratturo | 242/571.4 |
| 4,202,507 | A | * | 5/1980 | Fisher | 242/571.3 |
| 4,334,652 | A | | 6/1982 | Blackburn | |
| 4,711,406 | A | | 12/1987 | Barstow | |
| 4,730,779 | A | | 3/1988 | Thievessen | |
| 5,490,640 | A | | 2/1996 | Miller et al. | |
| 5,791,588 | A | | 8/1998 | Lindstrand | |
| 5,915,647 | A | | 6/1999 | Van Deurse | |
| 5,947,409 | A | | 9/1999 | Corrigan, Jr. | |
| 6,155,517 | A | * | 12/2000 | Lippold et al. | 242/571.5 |
| 6,206,323 | B1 | * | 3/2001 | Byars | 242/571.5 |

* cited by examiner

*Primary Examiner*—William A. Rivera
(74) *Attorney, Agent, or Firm*—John P. McGonagle

(57) ABSTRACT

An expandable, self-adjusting core plug which will maintain a fit between core plug and an out-of-round web roll core. The present invention accomplishes this by providing a core plug with a number of individual, elongated beveled ribs and a corresponding beveled spindle, both of which cooperatively and axially adjust the thickness of the core plug to meet variations in the inner diameter of the core.

12 Claims, 4 Drawing Sheets

EXPANDABLE CORE PLUG

This application claims priority from provisional application Ser. No. 60/178,873, filed Jan. 29, 2000.

BACKGROUND OF THE INVENTION

This invention relates to core plugs insertable into a web roll core, and in particular, to an expandable core plug for improved gripping of such cores.

In manufacturing and other operations, a roll of material may need to be mounted onto or off a roll. In conventional web treatments where machines handle reels of paper, plastics, metal foils, textiles and other sheet material, the cores of these reels need to be mounted on the machines so that rotational drive can be selectively coupled to the cores to effect winding or unwinding of the web entrained on the cores. The cores carrying the webs are normally tubular components made from cardboard, metal or plastic material. To effect the rotational drive to a core, it is desirable to include a core plug in either end of the core. The core plugs engage and rotatably support the core. Once the core plugs are inserted into the core, the core plugs are mounted on a roll stand which fits into journals of the core plugs.

As stated above, the cores are usually made of heavy paper or cardboard in tubular form. Cores, being made of paper, cannot be held to a close internal diameter tolerance. The cores become "out-of-round" affecting the fit of the core plug into the core. The core and core plug become loose thereby causing the core and core plugs to bang against each other. The looseness of fit between core and core plug can cause significant local stresses in the core to the point that the core structure and core plugs are damaged.

SUMMARY OF THE INVENTION

The present invention addresses the problem of prior art core plugs by providing an expandable, self-adjusting core plug which will maintain a fit between core plug and an out-of-round core. The present invention accomplishes this by providing a core plug with a number of individual, elongated beveled ribs and a corresponding beveled spindle, both of which cooperatively and axially adjust the thickness of the core plug to meet variations in the inner diameter of the core.

These together with other objects of the invention, along with various features of novelty which characterize the invention, are pointed out with particularity in this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 4:
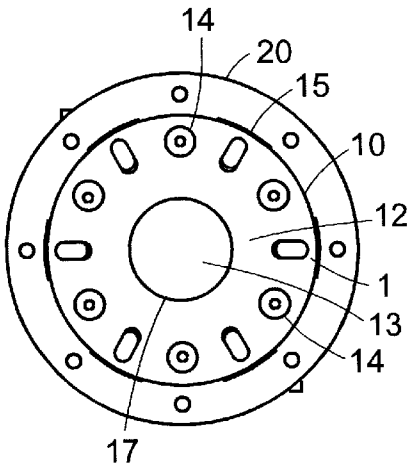
FIG. 4 is a plan view of FIG. 1 from the distal plate outer surface.
Figure 3:
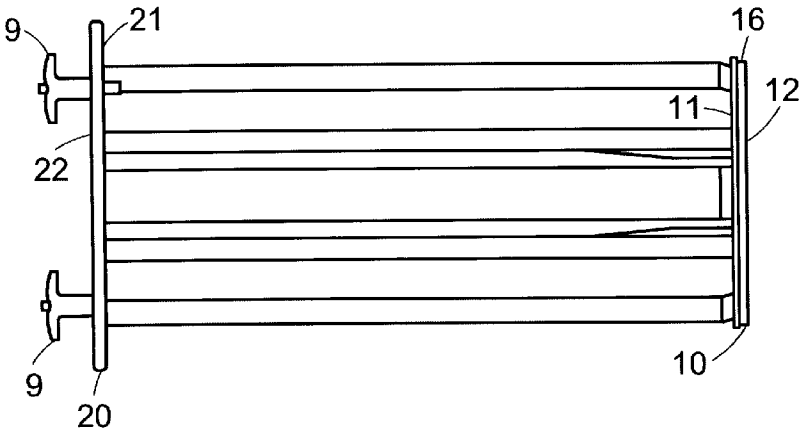
FIG. 3 is a side view of FIG. 1.
Figure 2:
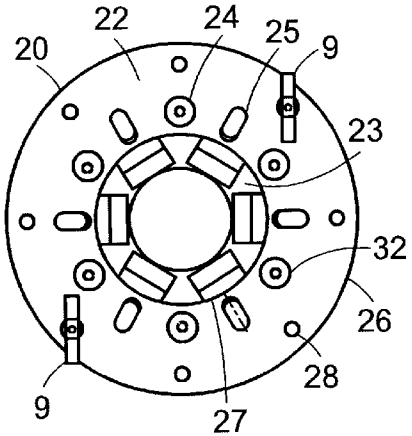
FIG. 2 is a plan view of FIG. 1 from the proximal plate outer surface.
Figure 1:
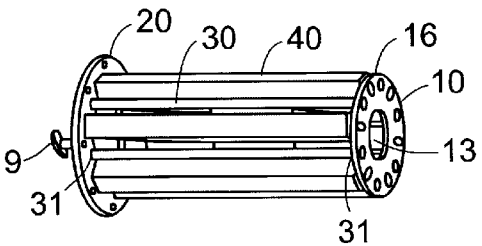
FIG. 1 is a perspective view of an expandable core plug assembly without spindle.
Figure 7:
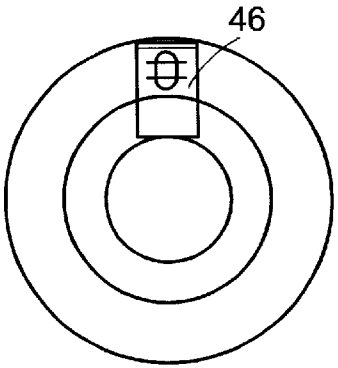
FIG. 7 is a plan view along the line 7—7 of FIG. 6, showing the position of the rib against a distal plate.
Figure 6:
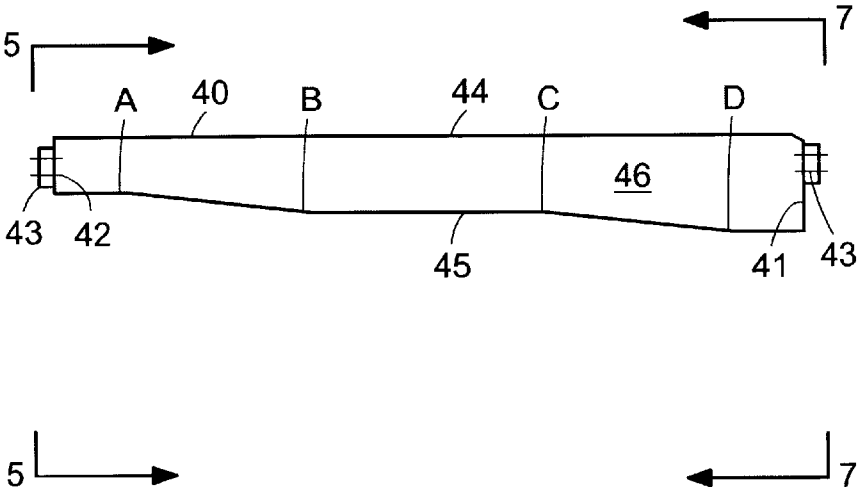
FIG. 6 is a side elevational view of a rib.
Figure 5:
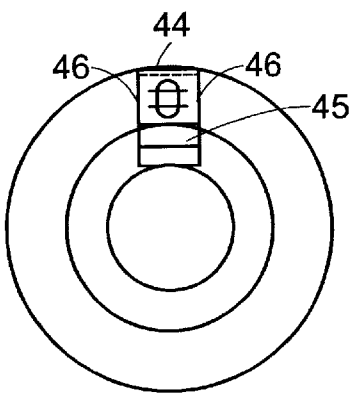
FIG. 5 is a plan view along the line 5—5 of FIG. 6, showing the position of the rib against a distal plate.
Figure 8:
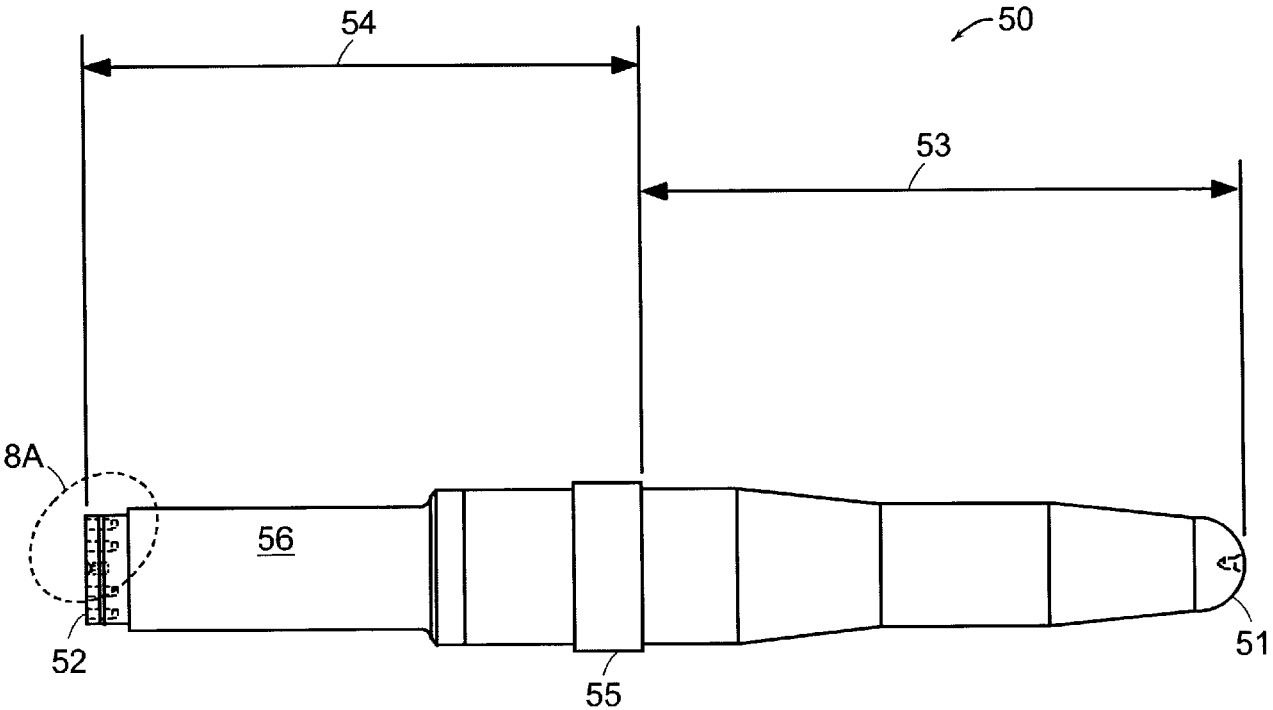
FIG. 8 is a side elevational view of the spindle.
Figure 8A:
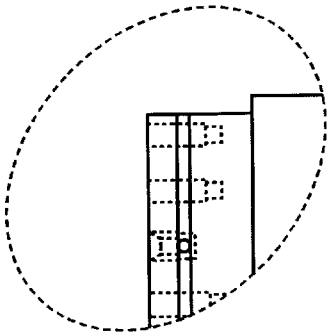
Figure 9:
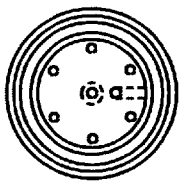
FIG. 9 is a proximal end view of the spindle.
Figure 11:
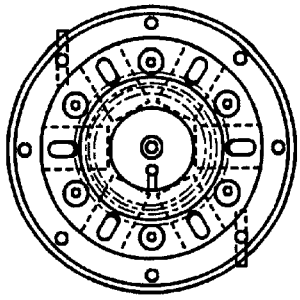
FIG. 11 is a distal end view of the invention.
Figure 10:
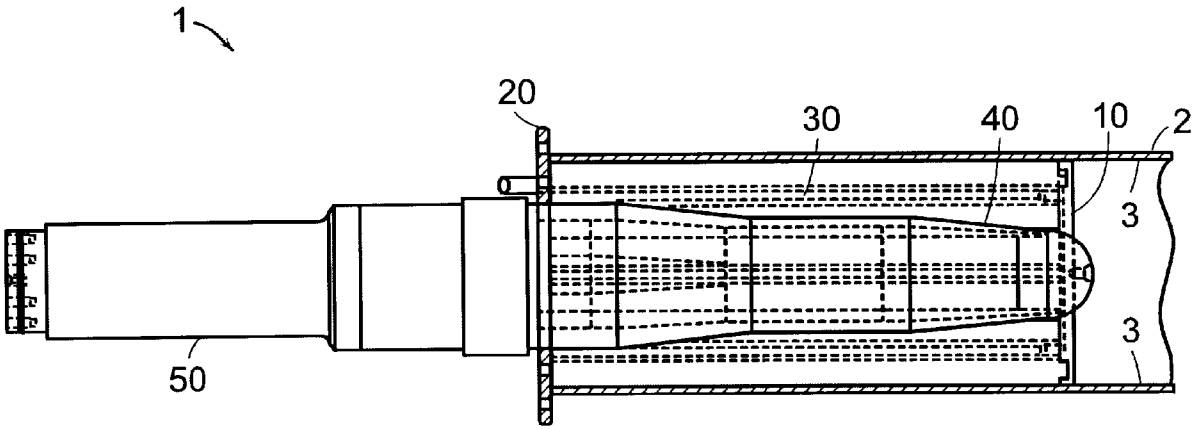
FIG. 10 is a side cross-sectional view of the invention.

Referring to the drawings in detail wherein like elements are indicated by like numerals, there is shown an expandable core plug assembly 1 constructed according to the principles of the present invention. In this embodiment of the invention the assembly 1 includes a round, flat, distal plate 10, a round, flat, proximal plate 20, six elongated spacers 30 interconnecting said plates 10, 20, six elongated, beveled ribs 40, generally parallel to and interspersed among said spacers 30 and also interconnecting said plates 10, 20, and an elongated, beveled spindle 50 centrally positioned within said assembly 1 and protruding through said proximal plate 20 to said distal plate 10, said spindle 50 being generally parallel to said spacers 30 and said ribs 40. Said plates 10, 20 each having a plane parallel to the plane of the other plate. The proximal plate 20 has a diameter greater than the distal plate 10. The assembly 1 has a generally cylindrical shape with the spacers 30 and ribs 40 acting as side walls extending from said distal plate 10 to said proximal plate 20, said plates 10, 20 defining the longitudinal axis of the assembly, said spindle 50 forming the central longitudinal axis of the assembly 1. The longitudinal axes of the spindle 50, ribs 40 and spacers 30 are generally perpendicular to the planes of said plates 10, 20. The assembly 1 is adapted to being inserted into a hollow web core 2, distal plate 10 first, up to, but not including, said proximal plate 20. The assembly ribs 40 engage the inner wall 3 of said web core 2.

The distal plate 10 has an inner surface 11 and an opposite, outer surface 12, said inner surface 11 facing the proximal plate 20. The distal plate 10 has a round, central opening 13 formed therein, as well as six round spacer holes 14 formed equidistantly near to the distal plate periphery 16. Interspaced between said spacer holes 14 are six oval shaped rib holes 15, each oval hole 15 having a longitudinal axis coincident with a radial axis of the plate 10. The central opening 13, spacer holes 14 and rib holes 15 extend through both surfaces 11, 12.

The proximal plate 20 has an inner surface 21 and an opposite, outer surface 22, said inner surface 21 facing the distal plate 10. The proximal plate 20 has a round, central opening 23 formed therein. The proximal plate 20 has six round equidistant spacer holes 24 formed about a circle midway between the central opening periphery 27 and the proximal plate periphery 26. Interspaced between said spacer holes 14 are six oval shaped rib holes 25, each oval hole 25 having a longitudinal axis coincident with a radial axis of the plate 20. The central opening 23, spacer holes 24 and rib holes 25 extend through both surfaces 21, 22. The proximal plate 20 also has eight round handle holes 28 formed equidistantly near to the proximal plate periphery 26. Each of the handle holes 28 is adapted to receive a removable pin handle 9.

The distal and proximal plates 10, 20 are interconnected by six spacers 30. Each spacer 30 has a slim, cylindrical shape terminating at each end 31 in a round peg 32. Each spacer end 31 abuts the inner surface 11, 21 of each plate 10, 20. The spacer end pegs 31 are each inserted into and fastened within a plate spacer hole 14, 24. The spacers 30 determine the length of the core plug assembly 1 and form the basic cylindrical shape of the assembly 1.

As stated above, six, elongated beveled ribs 40 are interspersed among the spacers 30. Each rib 40 has a distal end 41 and a proximal end 42, each said end 41, 42 terminating in an oval plug 43, and said ends 41, 42 defining the longitudinal axis of each rib 40. Each rib distal end 41 abuts the distal plate inner surface 11. Each rib proximal end 42 abuts the proximal plate inner surface 21. Each rib oval plug 43 is inserted into a plate rib hole 15, 25, each said rib oval plug 43 having a longitudinal axis coincident with a radial axis of the plates 10, 20. Each plate rib hole 15, 25 has a longitudinal axis 60 to 80 thousands of an inch greater than the longitudinal axis of a rib oval plug 43, thereby permitting some movement of each rib 40 outward from the assembly central longitudinal axis along a assembly radial axis. Each plate rib hole 15, 25 has a lateral axis 20 to 30 thousands of an inch greater than the longitudinal axis of a rib oval plug 43, thereby permitting some twisting movement of each rib 40.

Each rib 40 has a generally rectangular cross section and has an outside surface 44, an opposite inside surface 45, and two connecting side surfaces 46. The rib inside surface 45 faces the assembly, central longitudinal axis. The rib outside surface 44 and side surfaces 46 are smooth and flat. Each rib outside surface 44 is positioned radially further from the assembly central longitudinal axis than each spacer 30, and has a radius formed with the assembly central longitudinal axis greater than the radius of the distal plate 10, each said rib outside surface 44 being adapted to engage a web core inner wall 3.

Each rib inside surface 45 is beveled along its longitudinal axis. Beginning at the rib proximal end and moving longitudinally toward the distal end, the bevel arrangement is as follows. The plane of the first ten percent of the rib inside surface 45, up to transverse line A, is parallel with the assembly central axis. The plane of next twenty-five percent of the rib inside surface 45, up to transverse line B, is beveled toward the assembly central axis at a selected angle preferably between five and ten degrees. The plane of the next thirty percent of the rib inside surface 45, up to transverse line C, is parallel with the assembly central axis. The plane of next twenty-five percent of the rib inside surface 45, up to transverse line D, is beveled toward the assembly central axis at a selected angle preferably between five and ten degrees. The plane of the remaining ten percent of the rib inside surface 45, up to the distal plate inner surface 11, is parallel with the assembly central axis.

The present invention further includes an elongated, beveled spindle 50 having a distal end 51 and a proximal end 52, said spindle ends 51, 52 defining the longitudinal axis of the spindle 50. The spindle 50 is round along its length and is centrally positioned within said assembly 1, protruding through said proximal plate central opening 23 to and through said distal plate central opening 13, said spindle distal end 51 protruding through said distal end central opening 13. The spindle longitudinal axis is generally parallel to the longitudinal axis of the spacers 30 and the ribs 40.

The spindle 50 may be longitudinally divided into two portions, an internal portion 53 and an external portion 54. The spindle external portion 54 is defined by the spindle proximal end 52 and a ring 55 formed about the spindle surface 56 at an approximate spindle longitudinal midpoint. The spindle internal portion 53 is defined by the spindle distal end 51 back to, but not including, the ring 55. The spindle 50 is positioned within the assembly 1 so that the spindle internal portion 53 begins at the proximal plate central opening 23 extending through the distal plate central opening 13. The surface 56 of the spindle internal portion 53 is longitudinally and radially beveled to correspond to the rib inside surface 45 beveled contours. The spindle ring 55 has a diameter greater than the diameter of the proximal plate central opening 23, whereby the proximal plate central opening periphery 27 acts as a stop against the spindle ring 55 when the spindle is inserted into the assembly 1.

It is understood that the above-described embodiment is merely illustrative of the application. Other embodiments may be readily devised by those skilled in the art which will embody the principles of the invention and fall within the spirit and scope thereof. The number of ribs 40 and spacers 30 in the invention may be varied. The number of rib and spindle bevels as well as angles of bevels may be varied. The size of the plate rib holes 15, 25 relative to the rib plugs 43 may be varied. The shape of the plate rib holes 15, 25 and rib plugs 43 may be varied, e.g., round, square, etc.

I claim:

1. An expandable, self-adjusting core plug assembly adapted to maintain a fit between a core plug and an out-of-round, hollow web roll core, said web roll core having an inner wall defining said hollow core, comprising in combination:

a core plug comprising:

a round, flat, distal plate with a central opening formed therein;

a round, flat, proximal plate with a central opening formed therein;

a plurality of elongated spacers interconnecting said distal and proximal plates;

a plurality of elongated, beveled ribs, generally parallel to and interspersed among said spacers and interconnecting said plates;

an elongated, beveled spindle having a surface, a distal end and a proximal end, said spindle ends defining a longitudinal axis, said spindle being centrally positioned within said assembly, said spindle protruding through said proximal plate central opening to and through said distal plate central opening, said spindle distal end protruding through said distal end central opening, said spindle longitudinal axis being generally parallel to the longitudinal axis of the spacers and the ribs wherein said core plug and said spindle are cooperatively and axially adapted to adjust the thickness of the core plug to meet variations in the inner diameter of the web roll core.

2. An assembly as recited in claim 1, wherein:

said core plug has a generally cylindrical shape with the spacers and ribs acting as side walls extending from said distal plate to said proximal plate, said plates defining a longitudinal axis of the core plug, said distal and proximal plates each being in a plane parallel to the plane of the other plate, said proximal plate having a diameter greater than a distal plate diameter, said spindle forming a central longitudinal axis of the assembly, said ribs and spacers having longitudinal axes generally perpendicular to the planes of said plates;

wherein said core plug is adapted to being inserted into a hollow web core, said distal plate first, up to, but not including, said proximal plate;

wherein the assembly ribs engage the inner wall of said web roll core.

3. An assembly as recited in claim 2, wherein the distal plate is further comprised of:

an inner surface and an opposite, outer surface, said inner surface facing the proximal plate;

a plurality of spacer holes formed equidistantly near to a distal plate periphery;

a plurality of oval-shaped rib holes interspaced among said spacer holes, each oval hole having a longitudinal axis coincident with a radial axis of the distal plate;

wherein the central opening, spacer holes and rib holes extend through both surfaces.

4. An assembly as recited in claim 3, wherein the proximal plate is further comprised of:

an inner surface and an opposite, outer surface, said inner surface facing the distal plate;

a plurality of spacer holes formed equidistantly about a circle between the central opening and a proximal plate periphery;

a plurality of oval-shaped rib holes interspaced among said spacer holes, each oval hole having a longitudinal axis coincident with a radial axis of the proximal plate;

wherein the central opening, spacer holes and rib holes extend through both surfaces.

5. An assembly as recited in claim 4, wherein:

each spacer has a slim, elongated body with two opposite ends, each end terminating in a peg, one spacer end abutting the inner surface of the distal plate and the opposite spacer end abutting the inner surface of the proximal plate, each spacer end peg being inserted into and fastened within a plate spacer hole.

6. An assembly as recited in claim 5, wherein:

each rib has a distal end and a proximal end, each said end terminating in an oval plug, said ends defining a longitudinal axis of each rib, each rib distal end abutting the distal plate inner surface, each rib proximal end abutting the proximal plate inner surface, each rib oval plug adapted to being inserted into a plate rib hole, each said rib oval plug having a longitudinal axis coincident with a radial axis of the plates, each plate rib hole having a longitudinal and lateral axis greater than a longitudinal and lateral axis of a rib oval plug, whereby each said rib plug is adapted to move along the longitudinal and lateral axis of said plate rib hole.

7. An assembly as recited in claim 6, wherein:

each rib has an outside surface, an opposite inside surface, and two connecting side surfaces, said rib inside surface facing the assembly, central longitudinal axis, said rib outside surfaces and side surfaces being generally smooth and linear, each rib outside surface being positioned radially further from the assembly central longitudinal axis than each spacer, said rib outside surfaces having a radius formed with the assembly central longitudinal axis greater than the radius of the distal plate from the assembly central axis, each said rib outside surface being adapted to engage a web core inner wall.

8. An assembly as recited in claim 7, wherein each rib inside surface is further comprised of:

a first longitudinal portion extending from the rib proximal end a selected distance toward the rib's distal end, said first portion being parallel with the assembly central axis;

a second longitudinal portion extending from the first proximal portion a selected distance toward the rib's distal end, said second portion being beveled toward the assembly central axis at a selected angle;

a third longitudinal portion extending from the second longitudinal portion a selected distance toward the rib's distal end, said third portion being parallel with the assembly central axis;

a fourth longitudinal portion extending from the third proximal portion a selected distance toward the rib's distal end, said fourth portion being beveled toward the assembly central axis at a selected angle; and a fifth longitudinal portion extending from the fourth longitudinal portion a selected distance to the rib's distal end, said fifth portion being parallel with the assembly central axis.

9. An assembly as recited in claim 8, wherein said spindle is further comprised of:

a longitudinal external portion, said spindle external portion being defined by the spindle proximal end and a ring formed about the spindle surface at a selected spindle longitudinal point, said spindle ring having a diameter greater than the diameter of the core plug proximal plate central opening; and a longitudinal internal portion, said internal portion being defined by the spindle distal end back to said ring, wherein said internal portion begins at the core plug proximal plate central opening and extends through the core plug distal plate central opening, wherein the surface of the spindle internal portion is longitudinally and radially beveled to correspond to the rib inside surface beveled contours.

10. An assembly as recited in claim 9, wherein:

said rib inside surface second portion is beveled at an angle between five and ten degrees.

11. An assembly as recited in claim 10, wherein:

said rib inside surface fourth portion is beveled at an angle between five and ten degrees.

12. An assembly as recited in claim 11, wherein the core plug proximal plate is further comprised of:

a plurality of handle holes formed equidistantly near to the proximal plate periphery, wherein each handle hole is adapted to receive a removable pin handle from the proximal plate's outer surface.

* * * * *